US010071406B2

(12) United States Patent
Ichikawa et al.

(10) Patent No.: US 10,071,406 B2
(45) Date of Patent: Sep. 11, 2018

(54) STEEL SHEET PILE AND METHOD FOR MANUFACTURING THE SAME

(71) Applicant: NIPPON STEEL & SUMITOMO METAL CORPORATION, Tokyo (JP)

(72) Inventors: Kazutoshi Ichikawa, Kimitsu (JP); Hidetoshi Ito, Kimitsu (JP); Noriaki Onodera, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 284 days.

(21) Appl. No.: 14/652,709

(22) PCT Filed: Mar. 24, 2014

(86) PCT No.: PCT/JP2014/057985

§ 371 (c)(1),
(2) Date: Jun. 16, 2015

(87) PCT Pub. No.: WO2014/157036

PCT Pub. Date: Oct. 2, 2014

(65) Prior Publication Data

US 2015/0314345 A1 Nov. 5, 2015

(30) Foreign Application Priority Data

Mar. 28, 2013 (JP) ..... 2013-070394

(51) Int. Cl.
*C22C 38/46* (2006.01)
*C22C 38/48* (2006.01)
(Continued)

(52) U.S. Cl.
CPC ..... *B21B 1/026* (2013.01); *B21B 45/004* (2013.01); *B21B 45/0203* (2013.01); *C21D 8/00* (2013.01);
(Continued)

(58) Field of Classification Search
CPC ..... C21D 2211/004; C21D 2211/005; C21D 2211/009
See application file for complete search history.

(56) References Cited

U.S. PATENT DOCUMENTS 5,858,130 A 1/1999 Bodnar et al.
6,946,038 B2 * 9/2005 Jeong ..... C21D 8/021 148/232
(Continued)

FOREIGN PATENT DOCUMENTS

JP 8-60241 A 3/1996
JP 8-120337 A 5/1996
(Continued)

OTHER PUBLICATIONS

International Search Report, issued in PCT/JP2014/057985, dated Jun. 17, 2014.
(Continued)

*Primary Examiner* — Scott R Kastler
*Assistant Examiner* — Vanessa T. Luk
(74) *Attorney, Agent, or Firm* — Birch, Stewart, Kolasch & Birch, LLP

(57) ABSTRACT

In a steel sheet pile according to the present invention, a carbon equivalent $CE_N$ is 0.260 to 0.500, a structure includes a ferrite, a pearlite, a Widmanstätten ferrite, and a precipitate, the precipitate is one or both of Nb carbonitride and V carbonitride, a total number density of the precipitate is 0.10 to 0.30 pieces/μm$^2$, a total area ratio of the ferrite and the pearlite is 70% or more, an area ratio of the Widmanstätten ferrite is 1% or more, an average grain size of the ferrite and the pearlite is 10 to 80 μm, and a yield strength is 460 MPa or more.

2 Claims, 1 Drawing Sheet

(51) Int. Cl.

| | |
|---|---|
| ***C21D 8/02*** | (2006.01) |
| ***B21B 1/02*** | (2006.01) |
| ***C22C 38/26*** | (2006.01) |
| ***C22C 38/24*** | (2006.01) |
| ***C22C 38/16*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***B21B 45/00*** | (2006.01) |
| ***B21B 45/02*** | (2006.01) |
| ***C21D 8/00*** | (2006.01) |
| ***C22C 38/00*** | (2006.01) |
| ***C22C 38/12*** | (2006.01) |

(52) U.S. Cl.

CPC ..... *C21D 8/0226* (2013.01); *C22C 38/00* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/24* (2013.01); *C22C 38/26* (2013.01); *C22C 38/48* (2013.01); *C21D 2211/004* (2013.01); *C21D 2211/005* (2013.01); *C21D 2211/009* (2013.01)

(56) References Cited

U.S. PATENT DOCUMENTS

| | | | |
|---|---|---|---|
| 2010/0266440 | A1 | 10/2010 | Fagot |
| 2015/0056468 | A1 | 2/2015 | Kizu et al. |

FOREIGN PATENT DOCUMENTS

| | | | |
|---|---|---|---|
| JP | 9-287052 | A | 11/1997 |
| JP | 10-1721 | A | 1/1998 |
| JP | 10-152722 | A | 6/1998 |
| JP | 2003-253379 | A | 9/2003 |
| JP | 2003-313641 | A | 11/2003 |
| JP | 2004-323966 | A | 11/2004 |
| JP | 2006-249513 | A | 9/2006 |
| JP | 2007-332414 | A | 12/2007 |
| JP | 2010-144209 | A | 7/2010 |
| JP | 2012-41603 | A | 3/2012 |
| JP | 2012-122117 | A | 6/2012 |
| JP | 2012-201904 | A | 10/2012 |
| JP | 2013-53330 | A | 3/2013 |
| JP | 2013-227597 | A | 11/2013 |

OTHER PUBLICATIONS

Written Opinion of the International Searching Authority, issued in PCT/JP2014/057985, dated Jun. 17, 2014.

Extended European Search Report, dated Oct. 21, 2016, for European Application No. 14772752.3.

* cited by examiner

STEEL SHEET PILE AND METHOD FOR MANUFACTURING THE SAME

TECHNICAL FIELD

The present invention relates to a steel sheet pile used for retaining, water cutoff, and the like in civil engineering and construction fields and a method for manufacturing the same.

Priority is claimed on Japanese Patent Application No. 2013-070394, filed on Mar. 28, 2013, the content of which is incorporated herein by reference.

RELATED ART

A steel sheet pile is, in cross section, hat-shaped, U-shaped, Z-shaped, straight (I-shaped), H-shaped, or the like, and has connectors at both ends thereof. Such a steel sheet pile has been widely used as a steel material for retaining, water cutoff, and the like in conventional civil engineering and construction fields.

When the steel sheet pile is used for revetment in a deep harbor and is used on flimsy ground, the steel sheet pile receives a high degree of stress. In addition, since increasing the cell construction of a harbor structure for reducing construction costs is in demand, and in view of disaster prevention, when the steel sheet pile is used for the revetment structure of a river, strengthening a base metal and a weld portion of the steel sheet pile is in demand. Therefore, a steel sheet pile having yield stress of 460 MPa or more is needed.

In addition, since the steel sheet piles are welded together when they are used, it is necessary for the weld portion of the steel sheet pile to have a high degree of toughness. It may be considered that one means of enhancing the toughness of the weld portion of the steel sheet pile is decreasing the hardenability of the steel sheet pile. However, if the hardenability decreases, the yield stress of the steel sheet pile is deteriorated.

In order to solve the above-described problems, a technology which limits the carbon equivalent of the steel sheet pile to limit the hardenability thereof and which adds alloys having a low adverse effect on the toughness of the steel sheet pile has been proposed (for example, see Patent Documents 1 to 3). However, since the alloys are costly, the above-described technology has a problem of increasing the manufacturing cost of the steel sheet pile.

When the cost regarding the alloy is reduced and the steel sheet pile is manufactured with some manufacturing processes being omitted, controlled rolling can be used as a method for realizing high-strengthening of the base metal and the weld portion of the steel sheet pile. However, upward warpage and/or downward warpage may occur in the steel sheet pile during the controlled rolling. For this problem, a method of controlled rolling the steel sheet pile has been proposed, in which the controlled rolling is performed under predetermined rolling conditions and cooling conditions to control the shape of the warpage (for example, see Patent Document 4).

However, the method complicates the manufacturing method, since the rolling condition and the cooling condition in the controlled rolling must be precisely controlled. In addition, if hot rolling is performed at a low temperature as in the controlled rolling disclosed in Patent Document 4, the deformation resistance of the steel material increases, and thus, the load on a mill roll increases. Specifically, when a steel material similar to the steel sheet pile which is, in cross section, hat-shaped, U-shaped, Z-shaped, straight, H-shaped, or the like is manufactured by hot-rolling and when the deformation resistance of the steel material is high, the load on the mill roll extremely increases, and thus, the mill roll is easily cracked.

For this problem, a technology of increasing the amount of Al in a steel material (Al: 0.3 to 2.0 mass %) to ferrite-transform part of structure of the steel before hot-rolling is known (for example, see Patent Document 5). In Patent Document 5, a method for manufacturing the steel sheet pile, in which increase of a rolling force (the deformation resistance of the steel material) at a temperature range of 1000° C. or less is suppressed and in which yield strength (YP) of the steel sheet pile obtained by hot-rolling can be 390 N/mm$^2$ or more, is proposed.

However, in order to suppress the load on the mill roll as in the above-described technology and to enhance productivity, it is necessary to perform the hot-rolling at a high temperature. If the manufacturing method is used, it is difficult to secure strength by having hard phase such as bainite obtained by transformation from austenite in as-rolled condition.

PRIOR ART DOCUMENT

Patent Document

[Patent Document 1] Japanese Unexamined Patent Application, First Publication No. H09-287052

[Patent Document 2] Japanese Unexamined Patent Application, First Publication No. H10-001721

[Patent Document 3] Japanese Unexamined Patent Application, First Publication No. 2003-253379

[Patent Document 4] Japanese Unexamined Patent Application, First Publication No. 2006-249513

[Patent Document 5] Japanese Unexamined Patent Application, First Publication No. 2007-332414

DISCLOSURE OF THE INVENTION

Problems to be Solved by the Invention

As described above, it is necessary for the steel sheet pile to have high yield strength, high tensile strength and high toughness, as well as low hardenability. In addition, it is necessary for the manufacturing method of the steel sheet pile to suppress the amount of the alloys, to simplify the rolling conditions, and to decrease the load on the mill roll. On the other hand, there is no prior art which satisfies all of the requirements.

In view of the problems, an object of the invention is to solve the conflicting problems of conservation of alloys to suppress excess addition of costly alloys, easy manufacturability to realize manufacturing without deteriorating productivity, and increasing the yield strength to 460 MPa or more. That is, an object of the invention is to manufacture a steel sheet pile which requires weldability and toughness as well as high strength without lacking cost effectiveness and productivity and to provide a steel sheet pile having yield stress of 460 MPa or more and a method for manufacturing the same.

Means for Solving the Problem

Intensive studies have been carried out by the inventors on a method for controlling a precipitate in the steel material by limiting carbon equivalent and by hot-rolling the steel material including alloys at a high temperature. As a result, the inventors achieved a steel sheet pile having yield strength of 460 MPa or more without significantly deteriorating toughness due to accelerating precipitation of carbonitride by including a predetermined amount of V and Nb and by performing hot-rolling of which reduction at a high temperature is enhanced. In addition, the inventors found that it is preferable to strengthen ferrite-pearlite structure by using precipitation strengthening due to precipitated particle and to install a tabular Widmanstätten ferrite into structure.

The invention has been made in consideration of the above-described findings, and the gist of the invention is as follows.

(1) In a steel sheet pile according to an embodiment of the present invention, a chemical composition includes, in terms of mass %: C:0.05 to 0.18%; Si:0.10 to 0.50%; Mn:0.50 to 1.50%; Nb:0.040 to 0.050%; V:0.20 to 0.30%; Cu:0 to 0.40%; Ni:0 to 1.00%; Mo:0 to 1.00%; Cr:0 to 1.00%; Al: limited to less than 0.05%; and remainder including Fe and impurities, a carbon equivalent calculated by Expression 1 and Expression 2 is 0.260 to 0.500, a structure includes a ferrite, a pearlite, a Widmanstätten ferrite, and a precipitate, the precipitate is one or both of Nb carbonitride and V carbonitride, a number density of the precipitate is 0.10 to 0.30 pieces/$\mu m^2$, a total area ratio of the ferrite and the pearlite is 70% or more, an area ratio of the Widmanstätten ferrite is 1% or more, the average grain size of the ferrite and the pearlite is 10 to 80 μm, the yield strength is 460 to 550 MPa and the tensile strength is 550 to 740 MPa, $$CE_N = \langle C\rangle + f(C)\times\{\langle Mn\rangle/6+\langle Si\rangle/24+\langle Ni\rangle/20+(\langle Cr\rangle+\langle Mo\rangle+\langle Nb\rangle+\langle V\rangle)/5\}: \quad \text{Expression 1,}$$

$$f(C)=0.75+0.25\times\tan h\{20\times(\langle C\rangle-0.12)\}: \quad \text{Expression 2, and}$$

<C>, <Mn>, <Si>, <Ni>, <Cr>, <Mo>, <Nb>, and <V> express amounts of each element in terms of mass %, in which an amount of an element which is not included is considered to be 0%.

(2) In the steel sheet pile according to (1), the chemical composition may include one or more of, by mass %: Cu: 0.05 to 0.40%; Ni: 0.10 to 1.00%; Mo: 0.10 to 1.00%; and Cr: 0.10 to 1.00%.

(3) A method for manufacturing a steel sheet pile according to other embodiment of the present invention includes: heating a steel slab consisting of the chemical composition according to (1) or (2) to 1100 to 1350° C.; hot-rolling the steel slab under a condition in which a cumulative reduction at a region of 900° C. or more is 90% or more and the finishing temperature is 850° C. or more to obtain the steel sheet pile; and cooling the steel sheet pile.

Effects of the Invention

According to the above-described aspects of the present invention, it is possible not to excessively add alloys, to enhance productivity by rolling at a high temperature, to prevent a mill roll from cracking due to the rolling at the high temperature, and to provide a high strength steel sheet pile having yield stress of 460 MPa or more, tensile strength TS of 550 MPa or more, and impact value of 32 J or more and a method for manufacturing the same, and thus, the above-described aspects of the present invention remarkably contribute to the industry.

EMBODIMENTS OF THE INVENTION

Figure 1:
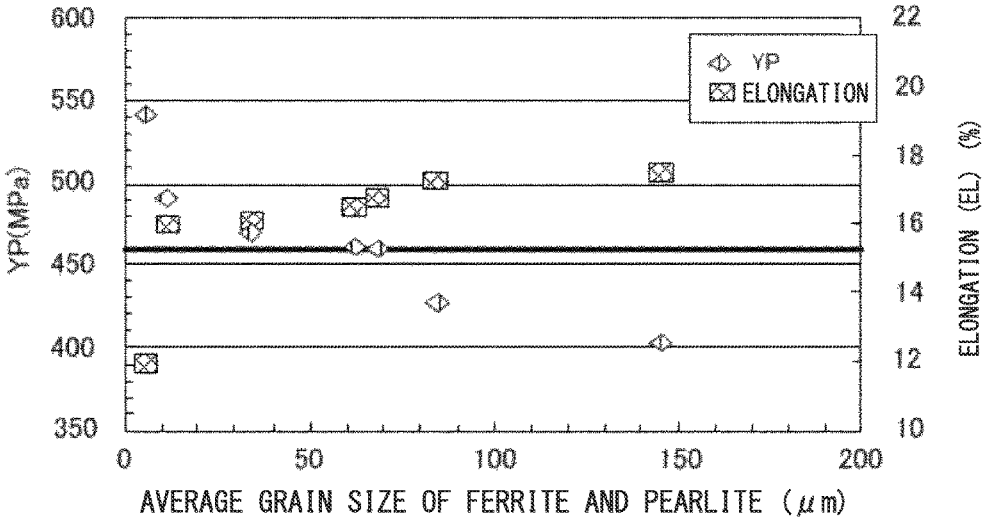
FIG. 1 is a graph indicating a relationship between strength and an average grain size of ferrite and pearlite, and a relationship between elongation and the average grain size of the ferrite and the pearlite according to the present embodiment.
Figure 2:
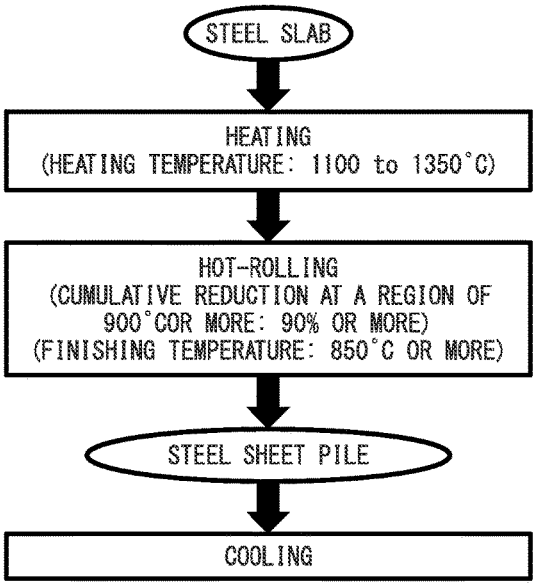
FIG. 2 is a flow chart indicating a method for manufacturing a steel sheet pile according to the present embodiment.

Hereinafter, a steel sheet pile according to an embodiment of the present invention will be described in detail. In the present embodiment, strength represents both of tensile strength and yield strength. In the present embodiment, a weld portion of the steel sheet pile represents a weld metal and a heat affected zone of the welded steel sheet pile. In the present embodiment, a base metal of the steel sheet pile represents a part other than the weld portion in the welded steel sheet pile (i.e. the base metal of the steel sheet pile is substantially equal to "steel sheet pile before welding").

In order to secure strength and toughness of the base metal of the steel sheet pile and toughness of the weld portion of the steel sheet pile, it is very important to control hardenability of the steel sheet pile. Controlling the hardenability is an optimization of an amount of C and an amount of other alloy components improving hardenability. The hardenability is evaluated by a carbon equivalent. An expression for calculating the carbon equivalent from amounts of each of the alloy components has been proposed.

In a case in which the hardenability is limited in order to secure toughness of the weld portion of the steel sheet pile, strength of the base metal decreases. In this case, it is typical that the strength of the base metal is increased by performing hot-rolling at a low temperature in manufacturing stage. On the other hand, it is preferable to perform the hot-rolling on the steel sheet pile at a high temperature in view of improving productivity and decreasing load on a mill roll. Therefore, it is difficult to satisfy all of enhancing strength and toughness of the base metal of the steel sheet pile, enhancing toughness of the weld portion of the steel sheet pile, and productivity. The inventors made a study of securing strength of the base metal and the weld portion of the steel sheet pile with a precipitation strengthening. Typically, the precipitation strengthening deteriorates toughness. However, the inventors conducted a study and found that, when appropriate amounts of Nb and V are included and a cumulative reduction within a high temperature range of 900° C. or more is 90% or more in the hot-rolling, precipitation of Nb carbonitride and V carbonitride is accelerated and a Widmanstätten structure is formed, and thus, coarsening of ferrite and pearlite is suppressed. The toughness of the steel sheet pile can be enhanced by suppressing coarsening of the ferrite and the pearlite.

The inventers further made a study to seek an optimization of a reduction and a temperature in the hot-rolling and an optimization of amounts of Nb and V and hardenability, and thus, achieved to obtain high strength steel sheet pile having yield stress of 460 MPa or more without deteriorating toughness of the base metal and the weld portion by controlling precipitation of the Nb carbonitride and the V carbonitride.

In the present invention, a hardenability index is a carbon equivalent $CE_N$ calculated by the known expression 1 and expression 2.

$$CE_N = \langle C\rangle + f(C)\times\{\langle Mn\rangle/6+\langle Si\rangle/24+\langle Ni\rangle/20+(\langle Cr\rangle+\langle Mo\rangle+\langle Nb\rangle+\langle V\rangle)/5\} \quad \text{(Expression 1)}$$

$$f(C)=0.75+0.25\times\tan h\{20\times(\langle C\rangle-0.12)\} \quad \text{(Expression 2)}$$

<C>, <Mn>, <Si>, <Ni>, <Cr>, <Mo>, <Nb>, and <V> express amounts of each element in terms of mass %, in which an amount of an element which is not included is considered as 0%.

First, a chemical composition of the steel sheet pile according to the present embodiment is described. The unit "%" regarding the chemical composition represents "mass %".

(C: 0.05 to 0.18%)

C is an element which is effective for enhancing strength of steel. The lower limit of an amount of C of the steel sheet pile according to the present embodiment is 0.05% to secure strength. On the other hand, when C is excessively included, the toughnesses of the base metal and the heat affected zone of the steel sheet pile decrease. Therefore, in the present embodiment, an upper limit of the amount of C is 0.18%. The lower limit of the amount of C is preferably 0.10% to further optimize a balance of the strength and the toughness.

(Si: 0.10 to 0.50%)

Si is a deoxidizing element. The lower limit of an amount of Si is 0.10% to sufficiently deoxidize. In addition, Si is an element having an effect of improving the strength and it is preferable that the amount of Si is 0.20% or more to obtain the effect. On the other hand, when the amount of Si is excess, the toughnesses of the base metal and the heat affected zone of the steel sheet pile decrease, and thus, the upper limit of the amount of Si is 0.50%.

(Mn: 0.50 to 1.50%)

Mn enhances the hardenability of the steel, and is effective for refining structure and for securing the strength and the toughness. In the present embodiment, the lower limit of an amount of Mn is 0.50% to secure the strength of the base metal of the steel sheet pile. On the other hand, when the amount of Mn is excess, the toughness of the weld portion of the steel sheet pile decreases due to increasing of the hardenability. Therefore, in the present embodiment, an upper limit of the amount of Mn is 1.50%. The upper limit of the amount of Mn is preferably 1.30% to further optimize a ratio of the strength and the toughness.

(Nb: 0.040 to 0.050%)

Nb is a very important element in the present embodiment. Nb combines with C and/or N to form a Nb carbonitride. The Nb carbonitride improves the strength of the base metal and the weld portion of the steel sheet pile by precipitation strengthening. The amount of Nb is 0.040% or more to obtain the effect. On the other hand, when more than 0.050% of Nb is included, the Nb carbonitride deteriorates the toughness of the base metal of the steel sheet pile, and increasing of the hardenability deteriorates the toughness of the weld portion of the steel sheet pile. Therefore, an upper limit of the amount of Nb is 0.050%. As noted above, the amount of Nb is 0.040 to 0.050%. The amount of Nb is preferably 0.040 to 0.045%.

(V: 0.20 to 0.30%)

V is a very important element in the present embodiment. V combines with C and/or N to form a V carbonitride. The V carbonitride improves the strength of the base metal and the weld portion of the steel sheet pile by precipitation strengthening. The amount of V is 0.20% or more to obtain the effect. On the other hand, when more than 0.30% of V is included, the toughness of the base metal of the steel sheet pile is deteriorated, and increasing of the hardenability deteriorates the toughness of the weld portion of the steel sheet pile. Therefore, an upper limit of the amount of V is 0.30%. As noted above, the amount of V is 0.20 to 0.30%. The amount of V is preferably 0.20 to 0.23%.

(Al: Less than 0.05%)

Al is a deoxidizing element, however, if Si which is other deoxidizing element is included, Al is not necessary essential. Therefore, the lower limit of an amount of Al is not limited. On the other hand, when the amount of Al is excess, the toughness of the steel sheet pile decreases due to formation of coarse Al oxide. Therefore, the amount of Al is limited to less than 0.05%. An upper limit of the amount of Al is preferably 0.03%, and more preferably 0.02%.

(Remainder: Fe and Impurities)

A remainder of the chemical composition of the steel sheet pile according to the present embodiment is Fe and impurities. The impurities represent a composition which is mixed through a material such as ore or scrap or through several factors of manufacturing process of the steel material and which is acceptable as long as a property of the steel sheet pile according to the present embodiment is not deteriorated thereby. In the present embodiment, typical impurities include P and S. P is a harmful composition which may embrittle the steel sheet pile and may deteriorate the strength of the base metal and the weld portion of the steel sheet pile. P may be included as long as an amount of P is 0.040% or less; however, the smaller the amount of P is, the more preferable it is. In addition, S is a harmful composition which may deteriorate the strength and the toughness of the base metal and the weld portion of the steel sheet pile. S may be included as long as the amount of S is 0.040% or less; however, the smaller the amount of S, the more preferable it is.

Moreover, in the present embodiment, optionally, one or more of Cu, Ni, Mo, and Cr may be included as optional elements. Including such elements is not essential, and thus, the lower limits of the amounts of the elements are 0%.

(Cu: 0 to 0.40%)

Cu is an element enhancing the strength of the base metal and the weld portion of the steel sheet pile by solid-solution into structure of the steel sheet pile. In order to obtain the effect, it is preferable that the amount of Cu is 0.05% or more. On the other hand, when Cu is excessively included, precipitation of CuS and deterioration of surface property may be caused, and thus, it is preferable that an upper limit of the amount of Cu is 0.40%.

(Ni: 0 to 1.00%)

Ni is an element enhancing the hardenability of the steel sheet pile and enhancing the strength and the toughness of the base metal and the weld portion of the steel sheet pile by solid-solution into the structure of the steel sheet pile. In order to obtain the effect, it is preferable that the amount of Ni is 0.10% or more. On the other hand, Ni is costly, and thus, it is preferable that the upper limit of the amount of Ni is 1.00%. The upper limit of the amount of Ni is more preferably 0.50%, and much more preferably 0.30%. When Cu is included, it is preferable that both of Cu and Ni are included in order to prevent the surface property from deteriorate.

(Mo: 0 to 1.00%)

Mo is an element enhancing the strength of the base metal and the weld portion of the steel sheet pile even if an amount thereof is extremely small. In order to obtain the effect, it is preferable that the amount of Mo is 0.10% or more. On the other hand, Mo enhances the strength of a steel in a high temperature (i.e. the steel sheet pile before rolling), and when Mo is excessively included, a deformation resistance of the steel sheet pile before rolling may increase which causes the mill roll to crack in rolling. Therefore, it is preferable that an upper limit of the amount of Mo is 1.00%.

The upper limit of the amount of Mo is more preferably 0.50%. In addition, the lower limit of the amount of Mo is preferably 0.30%.

(Cr: 0 to 1.00%)

Cr is an element enhancing the hardenability of the steel sheet pile and being effective to increase the strength. In order to obtain the effects, it is preferable that the amount of Cu is 0.10% or more. On the other hand, when Cr is excessively included, the toughness of the weld portion and the base metal of the steel sheet pile may be deteriorated. Therefore, it is preferable that an upper limit of the amount of Cr is 1.00%. The upper limit of the amount of Cr is more preferably 0.50% and much more preferably 0.30%.

(Carbon Equivalent $CE_N$: 0.260 to 0.500)

In the steel sheet pile according to the present embodiment, in order to secure the strength of the base metal and the weld portion of the base metal without deteriorating the toughness of the weld portion, a carbon equivalent $CE_N$ calculated by the known expression 1 and expression 2 is 0.260 to 0.500. The carbon equivalent $CE_N$ is an index of the hardenability. In order to secure yield stress of 460 MPa or more, it is necessary that a lower limit of the carbon equivalent $CE_N$ is 0.260. On the other hand, in order to secure the toughness of the base metal and the weld portion of the steel sheet pile, it is necessary that an upper limit of the carbon equivalent $CE_N$ is 0.500.

$$CE_N = \langle C\rangle + f(C)\times\{\langle Mn\rangle/6 + \langle Si\rangle/24 + \langle Ni\rangle/20 + (\langle Cr\rangle + \langle Mo\rangle + \langle Nb\rangle + \langle V\rangle)/5\} \quad \text{(Expression 1)}$$

$$f(C) = 0.75 + 0.25\times\tan h\{20\times(\langle C\rangle - 0.12)\} \quad \text{(Expression 2)}$$

<C>, <Mn>, <Si>, <Ni>, <Cr>, <Mo>, <Nb>, and <V> express amounts of each element in terms of mass %.

Next, the structure of the steel sheet pile according to the present embodiment will be described. A portion in which the structure of the steel sheet pile is defined is not limited; however, for example, when the structure of a ⅙ web width portion in the steel sheet pile (position spaced in a width direction of the web from the end of the web by a length of ⅙ of the width of the web) is controlled as described below, it can be considered that substantially all over the structure of the steel sheet pile is controlled adequately.

(Structure: Including a Ferrite, a Pearlite, a Widmanstätten Ferrite, and a Precipitate)

(Precipitate: One or Two of Nb Carbonitride and V Carbonitride)

The structure of the steel sheet pile according to the present embodiment includes a ferrite, a pearlite, and a Widmanstätten ferrite. In addition, it is preferable that the structure of the steel sheet pile according to the present embodiment include a precipitate. The precipitate is a carbonitride such as V(C, N), Nb(C, N), etc. A precipitation strengthening due to fine precipitate and a miniaturization of the structure due to a pinning effect of the fine precipitate secure the toughness of the base metal and the weld portion of the steel sheet pile and increase the strength of the base metal and the weld portion of the steel sheet pile. V(C, N) is called as V carbonitride and Nb(C, N) is called as Nb carbonitride.

The pearlite described herein is a layered structure of cementite and ferrite as well-known in general. The ferrite described herein is a normal ferrite having granular shape.

The Widmanstätten ferrite is a structure which grows with rate-controlled by diffusion of carbon atoms, in which Fe atoms transforms and grows with shear transformation as like to martensite transformation, and which is a tabular ferrite structure. The Widmanstätten ferrite is distinguished from the above-described normal ferrite.

The ferrite included in the pearlite and an acicular ferrite also have the tabular shape; however, the Widmanstätten ferrite is distinguished from the ferrite included in the pearlite and the acicular ferrite in the following points. The ferrite included in the pearlite constructs the layered structure together with the cementite as described above. On the other hand, the Widmanstätten ferrite constructs the layered structure without the cementite. The acicular ferrite radially grows with centering upon nonmetallic inclusion and the like. On the other hand, the Widmanstätten ferrite grows in tabular form from a boundary of an austenite or from a ferrite which has already transformed.

In the present embodiment, the Widmanstätten ferrite is defined as a tabular ferrite in which an aspect ratio L/W of a length L to a width W is 4 or more, which is not accompanied by a layered cementite, and which grows from a boundary of an austenite or from a ferrite which has already transformed. When the structure of two-dimensional cross section of the steel sheet pile is observed, the Widmanstätten ferrite can be distinguished from the normal ferrite, the ferrite included in the pearlite, and the acicular ferrite by the definition.

Including the ferrite increases the toughness. Including the pearlite increases the strength. An effect of preventing the ferrite and the pearlite from coarsening can be obtained by including the Widmanstätten ferrite. Increasing of the toughness of the steel sheet pile can be achieved by preventing the ferrite and the pearlite from coarsening.

(A Total Area Ratio of Ferrite and Pearlite: 70% or More)

(An Area Ratio of Widmanstätten Ferrite: 1% or More)

A total area ratio of the ferrite and the pearlite of the steel sheet pile according to the present embodiment is 70% or more. Thereby, the strength and the toughness of the base metal and the weld portion of the steel sheet pile can be sufficiently increased. A structure other than the ferrite, the pearlite, and the Widmanstätten ferrite, for example, bainite and the like may form as remainder structure. Including such a remainder structure is acceptable as long as the total area ratio of the ferrite and the pearlite are kept. It is not necessary to limit a content ratio of the ferrite, the pearlite, and the Widmanstätten ferrite. On the other hand, an amount of the Widmanstätten ferrite is 1% or more in terms of area %. When the area ratio of Widmanstätten ferrite is less than 1%, the above-described effect exhibited by the Widmanstätten ferrite cannot be obtained.

The total area ratio of the ferrite and the pearlite, and the area ratio of Widmanstätten ferrite were measured in accordance with a method of International Institute of Welding. That is, a grid having a total of 100 pieces of crossover points, i.e. 10 vertical pieces by 10 horizontal pieces of crossover point was mounted on a optical microscope photograph of structure, and structures regarding each crossover points were point-counted. The amounts of each of the structures were quantified by repeating the above-described method and averaging.

(A Total Number Density of Precipitate: 0.10 to 0.30 Pieces/$\mu m^2$)

When a total number per unit area of precipitate which is one or two of the Nb carbonitride and the V carbonitride is less than 0.10 pieces/$\mu m^2$, sufficiently strength cannot be obtained. On the other hand, when the total number per unit area of the Nb carbonitride and the V carbonitride is more than 0.30 pieces/$\mu m^2$, the toughness of the steel sheet pile deteriorates. Therefore, the total number density of the Nb carbonitride and the V carbonitride is 0.10 to 0.30 pieces/$\mu m^2$. The preferable total number per unit area of the Nb carbonitride and the V carbonitride is 0.11 to 0.25 pieces/

$\mu m^2$. The total number per unit area of the Nb carbonitride and the V carbonitride can be measured by analyzing a sample, which is an extraction replica, with a transmission electron microscope.

It is not necessary to define the size of the Nb carbonitride and the V carbonitride. On the other hand, it is assumed that a Nb carbonitride and a V carbonitride whose major axis is less than 10 nm do not substantially affect the properties of the steel sheet pile, and the Nb carbonitride and the V carbonitride whose major axis is less than 10 nm cannot be observed with the above-described extraction replica method. Therefore, the lower limit of the major axis of the Nb carbonitride and the V carbonitride is substantially 10 nm. In addition, when the Nb carbonitride and the V carbonitride having the above-described number density are included, a Nb carbonitride and a V carbonitride having a major axis of more than 300 nm are not formed. The inventors observed structures of various steel sheet piles according to the present embodiment, and as a result, the inventors did not find Nb carbonitride and V carbonitride having a major axis of more than 300 nm. Therefore, an upper limit of the major axis of the Nb carbonitride and the V carbonitride is substantially 300 nm.

(Average Grain Size of Ferrite and Pearlite: 10 to 80 μm)

When an average grain size of the ferrite and the pearlite (hereinafter, abbreviated as "average grain size" or "grain size" as appropriate) is more than 80 μm, the toughness and the strength of the base metal and the weld portion of the steel sheet pile may be deteriorated. On the other hand, when the average grain size of the steel sheet pile is less than 10 μm, an elongation of the steel sheet pile may be extremely deteriorated. If the elongation is deteriorated, the toughness is deteriorated. Therefore, it is preferable that the average grain size of the steel sheet pile is 10 to 80 μm.

The average grain size of the structure of the steel sheet pile according to the present embodiment can be obtained by observing with an optical microscope in accordance with JIS G 0551. The grain size of the pearlite structure can be obtained by applying the above-described method for measuring the grain size of ferrite grain to a pearlite colony ("island of pearlite" described in JIS G 0551). The "average grain size of ferrite and pearlite" represents the average grain size of both the ferrite and the pearlite. If, along the average grain size of either the ferrite or the pearlite is less than 10 μm or more than 80 μm, the average grain size of both of the ferrite and the pearlite is 10 to 80 μm, it is determined that the above-described definition is satisfied.

When the average grain size of the structure described above is measured, the Widmanstätten ferrite is ignored. In addition, an major axis of the Widmanstätten ferrite is typically 5 to 30 μm, and a variation of the major axis within the range does not affect the property of the steel sheet pile according to the present embodiment. Therefore, it is not necessary to define a size of the Widmanstätten ferrite in the present embodiment.

FIG. 1 represents a relationship between the average grain size (μm) of the ferrite and the pearlite of the steel sheet pile and the strength <YP (MPa)> and a relationship between the average grain size (μm) of the ferrite and the pearlite of the steel sheet pile and the elongation (%) in accordance with test results using a portion of samples. When the average grain size of the ferrite and the pearlite of the steel sheet pile is more than 80 μm, the yield strength may be less than 460 MPa, and when the average grain size of the ferrite and the pearlite of the steel sheet pile is less than 10 μm, the elongation may be deteriorated.

(Yield Strength: 460 to 550 MPa)

(Tensile Strength: 550 to 740 MPa)

Yield strength of the base metal of the steel sheet pile according to the present embodiment is 460 MPa or more in order to obtain an effect of decreasing plate thickness due to high-strengthening. In addition, tensile strength of the base metal of the steel sheet pile according to the present embodiment is 550 MPa or more in order to obtain the effect of decreasing plate thickness due to high-strengthening. Setting the yield strength and the tensile strength of the base metal of the steel sheet pile to be greater than the above-described values to lower the welding costs, the transport costs, and the construction costs is advantageous in regards to economic efficiency. On the other hand, in view of securing the toughness of the base metal and the weld portion of the steel sheet pile and enhancing weldability due to reducing the amount of alloys, it is preferable that the upper limit of the yield strength is 550 MPa and the upper limit of the tensile strength is 740 MPa. Such yield strength and tensile strength can be obtained when the steel sheet pile includes the above-described predetermined amount of alloys and the structure thereof becomes the predetermined state.

Next, a method for manufacturing the steel sheet pile according to the present embodiment will be described. The method for manufacturing a steel sheet pile according to the present embodiment includes: heating a steel slab, which includes C:0.05 to 0.18%, Si:0.10 to 0.50%, Mn:0.50 to 1.50%, Nb:0.040 to 0.050%, V:0.20 to 0.30%, Cu:0 to 0.40%, Ni:0 to 1.00%, Mo:0 to 1.00%, Cr:0 to 1.00%, Al: limited to less than 0.05%, and remainder including Fe and impurities and of which a carbon equivalent $CE_N$ is 0.260 to 0.500, to 1100 to 1350° C.; hot-rolling the steel slab under a condition in which a cumulative reduction at a region of 900° C. or more is 90% or more and a finishing temperature is 850° C. or more to obtain the steel sheet pile; and cooling the steel sheet pile. In the method for manufacturing a steel sheet pile according to the present embodiment, the chemical composition of the steel slab may include, in terms of mass %, one or more of Cu:0.05 to 0.40%, Ni:0.10 to 1.00%, Mo:0.10 to 1.00%, and Cr:0.10 to 1.00%.

In steel making, a chemical composition of a molten metal is controlled, and then the molten metal is casted to obtain the steel slab in an ordinary method. In view of productivity, the casting is preferably continuous casting. In addition, a thickness of the steel slab is preferably 200 mm or more in view of productivity, and the thickness of the steel slab is preferably 350 mm or less in view of the amount of time required for reducing segregation and for heating.

The steel sheet pile according to the present embodiment is manufactured by hot-rolling the steel slab. After the hot-rolling, the slab may be air-cooled, however, accelerated cooling can be applied in order to increase the strength and the toughness of the base metal and the weld portion of the steel sheet pile.

(Heating Temperature of Steel Slab Before Hot-Rolling: 1100 to 1350° C.)

The heating temperature of the steel slab before hot-rolling is 1100° C. or more. If the heating temperature is too low, the temperature of the steel slab falls during the hot-rolling, and thus, a deformation resistance of the steel slab excessively increases. On the other hand, if the heating temperature of the steel slab before the hot-rolling is higher than 1350° C., a load on a heating apparatus increases as well as the amount of scale which forms on a surface of the steel slab increases. Therefore, an upper limit of the heating temperature of the steel slab before the hot-rolling is 1350° C.

(Cumulative Reduction at a Region of 900° C. or More: 90% or More)

After heating the steel slab, hot-rolling is performed. In the hot-rolling, a cumulative reduction at a region of 900° C. or more is 90% or more. The hot-rolling condition can increase productivity and can prevent a roll from cracking due to reducing a load on the roll. If the cumulative reduction at the region of 900° C. or more is less than 90%, the total number density of the Nb carbonitride and the V carbonitride becomes less than 0.10 pieces/$m^2$, and the area ratio of the Widmanstätten ferrite becomes less than 1%. Thereby, coarsening of the ferrite and the pearlite occurs. The structure of the ferrite and the pearlite is miniaturized by increasing reduction in a lower-temperature-side of the range of 900° C. or more, and thus, the strength and the toughness of the base metal and the weld portion of the steel sheet pile can be further increased.

Typically, a "cumulative reduction" is a percentage of the amount of cumulative reduction (difference between a plate thickness before inputting into a first pass and a plate thickness after outputting from a last pass) with respect to a plate thickness at starting of rolling (i.e. the plate thickness just before inputting into the first pass of rolling apparatus). On the other hand, the "cumulative reduction at the region of 900° C. or more" can be obtained by the following expression.

$$r_{900}=(t_0-t)/t_0\times 100 \quad \text{(Expression 3)}$$

In the expression 3, $r_{900}$ represents the cumulative reduction at the region of 900° C. or more, $t_0$ represents a plate thickness at starting rolling, and t represents a plate thickness just before inputting into a rolling pass which starts rolling in a state in which a temperature of the steel slab is less than 900° C.

"Increasing a reduction in a lower-temperature-side of the range of 900° C. or more" represents setting a reduction of a pass having a relatively low temperature among passes performing rolling at the range of 900° C. or more (specially, a reduction of a pass performing rolling at a range of 900 to 1000° C.) to be larger than a reduction at a pass having a relatively high temperature (specially, a reduction at a pass performing rolling at a range of 1000° C. or more).

(Finishing Temperature: 850° C. or More)

A finishing temperature of the hot-rolling is 850° C. or more. If the hot-rolling is performed in less than 850° C., since ferrite transformation already starts, the hot-rolling becomes dual phase rolling. If the dual phase rolling is performed, a worked ferrite forms, and thus, the toughness of the base metal is deteriorated and the load on the roll increases due to increasing of the deformation resistance.

The steel sheet pile obtained by the hot-rolling is cooled. The method for cooling is not limited. For example, when the steel sheet pile which is hot-rolled as described above is cooled as a typical method for manufacturing a typical steel sheet pile, the steel sheet pile including 70 area % or more in total of the ferrite and the pearlite, 1 area % or more of the Widmanstätten ferrite, and the precipitate can be obtained.

EXAMPLES

Steel slabs having chemical compositions disclosed in Table 1 were manufactured by continuous casting. Steel sheet piles of which thickness of web was 10.8 mm were manufactured by heating the steel slabs obtained thereby in a furnace, and then hot-rolling. Manufacturing conditions therein are disclosed in Table 2. Tensile tests were performed on 14 B test pieces defined in JIS Z 2241 and collected from ⅙ web width portions (⅙W) in the steel sheet piles obtained thereby. In addition, Charpy impact tests were performed on test pieces in accordance with JIS Z 2242 collected from above-described locations. The Charpy impact test pieces were subsize test pieces (i.e. test pieces having height of 10 mm and width of 7.5 mm). When a Charpy absorbed energy (impact value) obtained by performing the Charpy impact test was higher than a desired value, it was determined that the toughness was good. Regarding mechanical property, a desired value of the yield strength YP is 460 MPa or more, a desired value of the tensile strength TS is 550 MPa or more, and a desired value of the impact value is 32 J or more.

In addition, samples were collected from the ⅙w portions, structures thereof were observed by optical microscope to confirm structure, and average grain sizes of the structures were measured. Furthermore, observing samples of extraction replica was performed by using TEM to obtain total number densities of the Nb carbonitrides and the V carbonitrides in the structures. Measuring the average grain size of the structure and the total number density of the Nb carbonitride and the V carbonitride in the structure was performed in an area of 10 μm square. The results are disclosed in Table 2.

No. 1 to No. 12 were examples and satisfied quality of material. The structures of the examples were mainly constructed by the ferrite, the pearlite, and the Widmanstätten ferrite and the area ratios of the Widmanstätten ferrite thereof were 1% or more as far as the above-described observing the structure. On the other hand, No. 13 to No. 27 were comparative examples and the strengths and/or the Charpy absorbed energies thereof did not reach to the desired values. No. 13, 26, 15, 17, 19, and 21 included small amounts of C, Si, Mn, Nb, and V, respectively, and therefore, the yield strengths thereof did not satisfy the desired value. No. 14, 16, 18, 20, 22, and 23 included excessive amounts of C, Si, Mn, Nb, V, and Al, respectively, and therefore, the toughnesses thereof were deteriorated. No. 24 had low toughness, since $CE_N$ thereof was excessive. No. 25 had low impact value, since $CE_N$ thereof was insufficient. No. 27 had low impact value, since the heating temperature before rolling thereof was insufficient, and thus, the Widmanstätten ferrite did not form.

TABLE 1

| Steel | CHEMICAL COMPOSITION (mass %) | | | | | | | | | | | | |
|---|---|---|---|---|---|---|---|---|---|---|---|---|---|
| No. | C | Mn | Si | Nb | Al | V | Cu | Ni | Mo | Cr | $CE_N$ | MAIN STRUCTURES | REMARKS |
| 1 | 0.16 | 1.18 | 0.23 | 0.040 | 0.02 | 0.20 | | | | | 0.393 | FERRITE-PEARLITE-WIDMANSTÄTTENFERRITE | EXAMPLES |
| 2 | 0.16 | 1.17 | 0.23 | 0.040 | 0.02 | 0.30 | | | | | 0.410 | FERRITE-PEARLITE-WIDMANSTÄTTENFERRITE | |
| 3 | 0.07 | 1.50 | 0.40 | 0.047 | 0.02 | 0.20 | | 0.50 | | | 0.261 | FERRITE-PEARLITE-WIDMANSTÄTTENFERRITE | |

TABLE 1-continued

| Steel | CHEMICAL COMPOSITION (mass %) | | | | | | | | | | | | |
|---|---|---|---|---|---|---|---|---|---|---|---|---|---|
| No. | C | Mn | Si | Nb | Al | V | Cu | Ni | Mo | Cr | $CE_N$ | MAIN STRUCTURES | REMARKS |
| 4 | 0.17 | 0.90 | 0.22 | 0.040 | 0.02 | 0.21 | | | | | 0.367 | FERRITE-PEARLITE-WIDMANSTÄTTENFERRITE | |
| 5 | 0.15 | 1.30 | 0.12 | 0.040 | 0.02 | 0.20 | | | | | 0.388 | FERRITE-PEARLITE-WIDMANSTÄTTENFERRITE | |
| 6 | 0.09 | 1.30 | 0.48 | 0.040 | 0.02 | 0.22 | | | | | 0.268 | FERRITE-PEARLITE-WIDMANSTÄTTENFERRITE | |
| 7 | 0.17 | 0.50 | 0.30 | 0.040 | 0.02 | 0.20 | | | | | 0.305 | FERRITE-PEARLITE-WIDMANSTÄTTENFERRITE | |
| 8 | 0.16 | 1.18 | 0.23 | 0.040 | 0.04 | 0.21 | | | | | 0.395 | FERRITE-PEARLITE-WIDMANSTÄTTENFERRITE | |
| 9 | 0.09 | 1.30 | 0.48 | 0.040 | 0.02 | 0.20 | 0.40 | | | | 0.265 | FERRITE-PEARLITE-WIDMANSTÄTTENFERRITE | |
| 10 | 0.08 | 1.20 | 0.48 | 0.040 | 0.02 | 0.21 | | 0.95 | | | 0.265 | FERRITE-PEARLITE-WIDMANSTÄTTENFERRITE | |
| 11 | 0.07 | 1.30 | 0.47 | 0.040 | 0.02 | 0.20 | | | 0.40 | | 0.274 | FERRITE-PEARLITE-WIDMANSTÄTTENFERRITE | |
| 12 | 0.08 | 1.21 | 0.48 | 0.040 | 0.02 | 0.22 | | | | 0.20 | 0.263 | FERRITE-PEARLITE-WIDMANSTÄTTENFERRITE | |
| 13 | 0.03 | 1.50 | 0.45 | 0.040 | 0.02 | 0.20 | | | | | 0.193 | FERRITE-PEARLITE-WIDMANSTÄTTENFERRITE | COMPARATIVE EXAMPLES |
| 14 | 0.19 | 1.01 | 0.21 | 0.040 | 0.02 | 0.20 | | | | | 0.409 | FERRITE-PEARLITE-WIDMANSTÄTTENFERRITE | |
| 15 | 0.15 | 1.20 | 0.07 | 0.040 | 0.02 | 0.20 | | | | | 0.372 | FERRITE-PEARLITE-WIDMANSTÄTTENFERRITE | |
| 16 | 0.16 | 1.18 | 0.53 | 0.040 | 0.02 | 0.20 | | | | | 0.404 | FERRITE-PEARLITE-WIDMANSTÄTTENFERRITE | |
| 17 | 0.16 | 0.45 | 0.23 | 0.040 | 0.02 | 0.20 | | | | | 0.281 | FERRITE-PEARLITE-WIDMANSTÄTTENFERRITE | |
| 18 | 0.16 | 1.59 | 0.23 | 0.040 | 0.02 | 0.20 | | | | | 0.455 | FERRITE-PEARLITE-WIDMANSTÄTTENFERRITE | |
| 19 | 0.11 | 1.18 | 0.23 | 0.031 | 0.02 | 0.20 | | | | | 0.287 | FERRITE-PEARLITE-WIDMANSTÄTTENFERRITE | |
| 20 | 0.10 | 1.17 | 0.23 | 0.053 | 0.02 | 0.20 | | | | | 0.267 | FERRITE-PEARLITE-WIDMANSTÄTTENFERRITE | |
| 21 | 0.16 | 1.18 | 0.23 | 0.040 | 0.02 | 0.15 | | | | | 0.384 | FERRITE-PEARLITE | |
| 22 | 0.16 | 1.18 | 0.23 | 0.040 | 0.02 | 0.32 | | | | | 0.415 | FERRITE-PEARLITE-WIDMANSTÄTTENFERRITE | |
| 23 | 0.16 | 1.18 | 0.23 | 0.040 | 0.07 | 0.20 | | | | | 0.393 | FERRITE-PEARLITE-WIDMANSTÄTTENFERRITE | |
| 24 | 0.18 | 1.49 | 0.45 | 0.050 | 0.02 | 0.29 | | | | | 0.501 | FERRITE-PEARLITE-WIDMANSTÄTTENFERRITE | |
| 25 | 0.05 | 1.49 | 0.49 | 0.040 | 0.04 | 0.20 | | | 0.35 | | 0.254 | FERRITE-PEARLITE-WIDMANSTÄTTENFERRITE | |
| 26 | 0.04 | 1.49 | 0.49 | 0.040 | 0.04 | 0.20 | | | 0.60 | | 0.267 | FERRITE-PEARLITE-WIDMANSTÄTTENFERRITE | |
| 27 | 0.16 | 1.18 | 0.23 | 0.040 | 0.02 | 0.20 | | | | | 0.393 | FERRITE-PEARLITE | |

A BLANK COLUMN MEANS THAT AN ELEMENT REGARDING THERETO IS NOT DELIBERATELY INCLUDED.
AN UNDERLINED VALUE IS OUT OF RANGE OR THE PRESENT INVENTION.

TABLE 2

| Steel No. | HEATING TEMPERATURE ° C. | CUMULATIVE REDUCTION AT A REGION OF 900° C. OR MORE % | FINISHING TEMPERATURE ° C. | YP MPa | TS MPa | ELONGATION % | IMPACT VALUE J | AVERAGE GRAIN SIZE OF FERRITE AND PEARLITE μm | TOTAL NUMBER DENSITY OF Nb CARBONITRIDE AND V CARBONITRIDE picces/μm$^2$ | REMARKS |
|---|---|---|---|---|---|---|---|---|---|---|
| 1 | 1300 | 90 | 860 | 490 | 630 | 17 | 50 | 13 | 0.15 | EXAMPLES |
| 2 | 1300 | 93 | 880 | 494 | 635 | 16 | 45 | 12 | 0.27 | |
| 3 | 1250 | 97 | 910 | 467 | 559 | 18 | 78 | 31 | 0.11 | |
| 4 | 1250 | 97 | 890 | 481 | 620 | 18 | 60 | 17 | 0.15 | |
| 5 | 1250 | 97 | 890 | 495 | 639 | 16 | 45 | 13 | 0.16 | |
| 6 | 1250 | 97 | 900 | 464 | 571 | 19 | 112 | 70 | 0.12 | |
| 7 | 1250 | 97 | 890 | 474 | 610 | 18 | 117 | 30 | 0.20 | |
| 8 | 1330 | 97 | 910 | 480 | 618 | 18 | 69 | 20 | 0.15 | |
| 9 | 1280 | 97 | 890 | 468 | 577 | 19 | 113 | 65 | 0.13 | |
| 10 | 1150 | 97 | 900 | 465 | 570 | 19 | 111 | 51 | 0.12 | |
| 11 | 1280 | 97 | 900 | 482 | 619 | 19 | 70 | 20 | 0.11 | |
| 12 | 1280 | 97 | 890 | 478 | 615 | 18 | 100 | 21 | 0.11 | |

TABLE 2-continued

| Steel No. | HEATING TEMPERATURE ° C. | CUMULATIVE REDUCTION AT A REGION OF 900° C. OR MORE % | FINISHING TEMPERATURE ° C. | YP MPa | TS MPa | ELONGATION % | IMPACT VALUE J | AVERAGE GRAIN SIZE OF FERRITE AND PEARLITE μm | TOTAL NUMBER DENSITY OF Nb CARBONITRIDE AND V CARBONITRIDE picces/μm$^2$ | REMARKS |
|---|---|---|---|---|---|---|---|---|---|---|
| 13 | 1300 | 97 | 900 | 440 | 568 | 20 | 72 | 85 | 0.08 | COMPARATIVE EXAMPLES |
| 14 | 1250 | 97 | 910 | 495 | 630 | 14 | 30 | 11 | 0.20 | |
| 15 | 1250 | 97 | 870 | 435 | 555 | 21 | 32 | 89 | 0.15 | |
| 16 | 1300 | 97 | 880 | 490 | 630 | 15 | 27 | 14 | 0.15 | |
| 17 | 1300 | 97 | 910 | 455 | 585 | 19 | 28 | 90 | 0.17 | |
| 18 | 1280 | 90 | 860 | 498 | 631 | 16 | 31 | 20 | 0.16 | |
| 19 | 1280 | 93 | 870 | 454 | 582 | 17 | 70 | 26 | 0.13 | |
| 20 | 1280 | 97 | 860 | 495 | 629 | 16 | 21 | 19 | 0.26 | |
| 21 | 1300 | 97 | 890 | 453 | 578 | 17 | 80 | 38 | 0.11 | |
| 22 | 1250 | 93 | 870 | 498 | 640 | 15 | 20 | 12 | 0.32 | |
| 23 | 1300 | 97 | 870 | 478 | 620 | 15 | 30 | 42 | 0.15 | |
| 24 | 1250 | 90 | 850 | 497 | 625 | 15 | 19 | 13 | 0.16 | |
| 25 | 1280 | 97 | 860 | 455 | 629 | 16 | 69 | 30 | 0.25 | |
| 26 | 1280 | 97 | 860 | 456 | 630 | 16 | 70 | 31 | 0.26 | |
| 27 | 1050 | 97 | 840 | 461 | 570 | 16 | 30 | 85 | 0.09 | |

AN UNDERLINED VALUE IS OUT OF RANGE OR THE PRESENT INVENTION.

INDUSTRIAL APPLICABILITY

According to the present invention, a high-strength steel sheet pile in which alloys are not excessively included, productivity is enhanced and mill roll is prevented from cracking by rolling at high temperature, a yield stress is 460 MPa or more, a tensile strength TS is 550 MPa or more, and an impact value is 32 J or more and a manufacturing method thereof can be provided, and therefore, the present invention remarkably contributes to the industry.

The invention claimed is:

1. A steel sheet pile, wherein a chemical composition consists of, in terms of mass %:

C: 0.05 to 0.18%;

Si: 0.10 to 0.50%;

Mn: 0.50 to 1.50%;

Nb: 0.040 to 0.050%;

V: 0.20 to 0.30%;

Cu: 0 to 0.40%;

Ni: 0 to 1.00%;

Mo: 0 to 1.00%;

Cr: 0 to 1.00%;

Al: limited to less than 0.05%;

P: 0.040% or less;

S: 0.040% or less;

and remainder including Fe and impurities, a carbon equivalent calculated by Expression 1 and Expression 2 is 0.260 to 0.500, a structure includes a ferrite, a pearlite, a Widmanstätten ferrite, and a precipitate, the precipitate is one or both of Nb carbonitride and V carbonitride, a number density of the precipitate is 0.10 to 0.30 pieces/μm$^2$, a total area ratio of the ferrite and the pearlite is 70% or more, an area ratio of the Widmanstätten ferrite is 1% or more, an average grain size of the ferrite and the pearlite is 10 to 80 μm, a yield strength is 460 to 550 MPa and a tensile strength is 550 to 740 MPa, $$CE_N = \langle C\rangle + f(C)\times\{\langle Mn\rangle/6 + \langle Si\rangle/24 + \langle Ni\rangle/20 + (\langle Cr\rangle + \langle Mo\rangle + \langle Nb\rangle + \langle V\rangle)/5\}: \quad \text{Expression 1,}$$

$$f(C) = 0.75 + 0.25\times\tan h\{20\times(\langle C\rangle - 0.12)\}: \quad \text{Expression 2, and}$$

<C>, <Mn>, <Si>, <Ni>, <Cr>, <Mo>, <Nb>, and <V> express amounts of each element in terms of mass %, in which an amount of an element which is not included is considered to be 0%.

2. A method for manufacturing the steel sheet pile according to claim 1, the method comprising:

heating a steel slab consisting of the chemical composition according to claim 1 to 1100 to 1350° C.;

hot-rolling the steel slab under a condition in which a cumulative reduction at a region of 900° C. or more is 90% or more and a finishing temperature is 850° C. or more to obtain the steel sheet pile; and cooling the steel sheet pile.

* * * * *